United States Patent [19]

Geringer et al.

[11] Patent Number: 4,623,178

[45] Date of Patent: Nov. 18, 1986

[54] LOCK ASSEMBLY

[76] Inventors: Arthur V. Geringer, 4611 Deseret Dr., Woodland Hills, Calif. 91364; Richard G. Geringer, 28834 Barragan St.; David A. Geringer, 5382 Cheseboro Rd., both of Agoura, Calif.

[21] Appl. No.: 789,946

[22] Filed: Oct. 21, 1985

[51] Int. Cl.[4] ..... E05C 1/16

[52] U.S. Cl. ..... 292/173; 292/DIG. 61; 292/DIG. 62

[58] Field of Search ..... 292/144, 150, 146, 106, 292/207, 336.3, DIG. 17, DIG. 61, DIG. 62

[56] References Cited

U.S. PATENT DOCUMENTS

| | | | |
|---|---|---|---|
| 1,126,181 | 1/1915 | Cleaver | 292/150 X |
| 3,069,193 | 12/1962 | Kirk | 292/144 |
| 4,437,693 | 3/1984 | Godec | 292/150 |

FOREIGN PATENT DOCUMENTS

| | | | |
|---|---|---|---|
| 476638 | 5/1929 | Fed. Rep. of Germany | 292/146 |

*Primary Examiner*—Richard E. Moore

*Attorney, Agent, or Firm*—John J. Posta, Jr.

[57] ABSTRACT

The assembly includes a door with rotatable door handle connected thereto, and a primary locking mechanism on a door hinged for opening and closing in a frame disposed in an entry way. The door includes a handle hub lock mechanism, including an actuator connected to a biasing force reversal mechanism for causing locking of the handle in a given position. The biasing mechanism preferably includes an actuator extendible from the leading door edge towards and alternatively into a recess in the door jamb. A lost-motion mechanism interconnects the actuator and the force reversal mechanism. The actuator normally extends outwardly from the door edge a significantly greater distance than the distance between the strike plate and the door edge. An adjustible connector mechanism interconnects the actuator and the primary door latch which causes both to move in tandem, whereby closure of the door causes the strike plate to cam the latch which, in turn, moves the actuator and allows the recessed actuator to clear the strike plate as the door is closed.

5 Claims, 7 Drawing Figures

LOCK ASSEMBLY

BACKGROUND OF THE INVENTION

1. Field of the Invention

The present invention generally relates to entry way closure assemblies and, more particularly, to such an assembly which includes a door, door frame, handle and closing mechanism and which has an improved type of door handle hub locking mechanism.

2. Prior Art

Security doors and the like generally include a variety of devices which operate to hold a security door shut in a frame and to automatically or selectively lock the door in the closed position. Certain security doors employ mechanisms to "freeze" the door handle against rotation in order to double lock the door in the closed position. One improved type of security door which employs a door handle lock is disclosed particularly in applicants' co-pending U.S. patent application, Ser. No. 528,873, filed Sept. 1, 1983, said application being entitled "Locking and Monitoring Assembly. That door employs a mechanism which has a plate secured around the handle hub within the door, and a slide bolt in the door, which bolt is levered into and out of locking position in a recess in the hub plate. Difficulties sometimes arise with that mechanism when the door handle is not initially in the full resting position and thus is not fully aligned to easily receive the slide bolt to lock the handle. In such a circumstance, the bolt tightly binds against the periphery of the plate and cannot seat in the recess so that the door handle is jammed, cannot be turned easily and remains unlocked, whether or not that fact is known, requiring the bolt movement activator to be backed off and the handle returned to full rest position before proper locking can be effected.

A proposed remedy to overcome this problem has been to provide a lost-motion biasing assembly as is disclosed in applicants' co-pending U.S. patent application Ser. No. 06/730,569, filed 5/06/85 and entitled "Improved Entry Closure Assembly". This invention is applicable where the direction of movement of bolt is in the same direction as the biasing means. However, this solution would not be applicable in lock assemblies where movement of the bolt is in a different direction from the biasing means.

A proposed remedy to overcome this problem has been to provide a reverse actuator mechanism such as is set forth and disclosed in applicants' co-pending U.S. patent application, Ser. No. 757,438, filed 7/22/85, and entitled "Reverse Closure Assembly".

However, it has been determined that although the prior lock assemblies worked satisfactorily, they could be improved upon. For example, in practice, when a door is hung, building specifications generally call for a small space of approximately $\frac{1}{8}$ inch between the door and the door jamb. For various reasons, including sloppy workmanship, this space is sometimes $\frac{3}{8}$ inch or greater. If this be the case, the actuator of the locking assembly in applicants' U.S. patent application Ser. No. 757,438 would not be cammed into an operative position. One could increase the length of the actuator, but if the camming head of such an elongated actuator extended past the jamb's strike plate, the door could not close.

Accordingly, there is a need for a new and improved locking assembly which utilizes an elongated actuator but permits such actuator to pass by the strike plate.

SUMMARY OF THE INVENTION

The improved entry closure assembly of the present invention satisfies all the foregoing needs. The assembly is substantially as set forth in the Abstract above. Thus, it includes a door hingedly or otherwise secured for movement between an open and a closed position in a door frame containing a door jamb. The assembly includes a primary door locking mechanism, such as a latch secured to the door extending into the jamb when the door is in the closed position and operable by suitable means to retract to allow the door to be opened. The door includes a door handle hub locking device, such as one having a hub locking plate with a peripheral protrusion and a slide bolt member with a recess adapted to receive the protrusion, which is supported for movement so as to lock and unlock the handle against rotation. The hub locking device includes biasing means connected to the slide bolt member for biasing it into and out of the locked position. The actuating assembly includes a lost-motion member and biasing force direction-reversing means. The actuating assembly also includes an elongated portion that terminates in a flat surface and is sufficiently long so as to extend outwardly from the door a distance significantly greater than the distance between the door and strike plate. The actuator and the latch are interconnected to move in tandem into the lock assembly when the latch is cammed toward the lock assembly by wedging against the strike plate when closing the door. A solenoid actuated device can be provided to selectively interact with the actuator to cause a "freezing" of the door handle hub.

DRAWINGS

DETAILED DESCRIPTION

FIGS. 1–4

Figure 1:
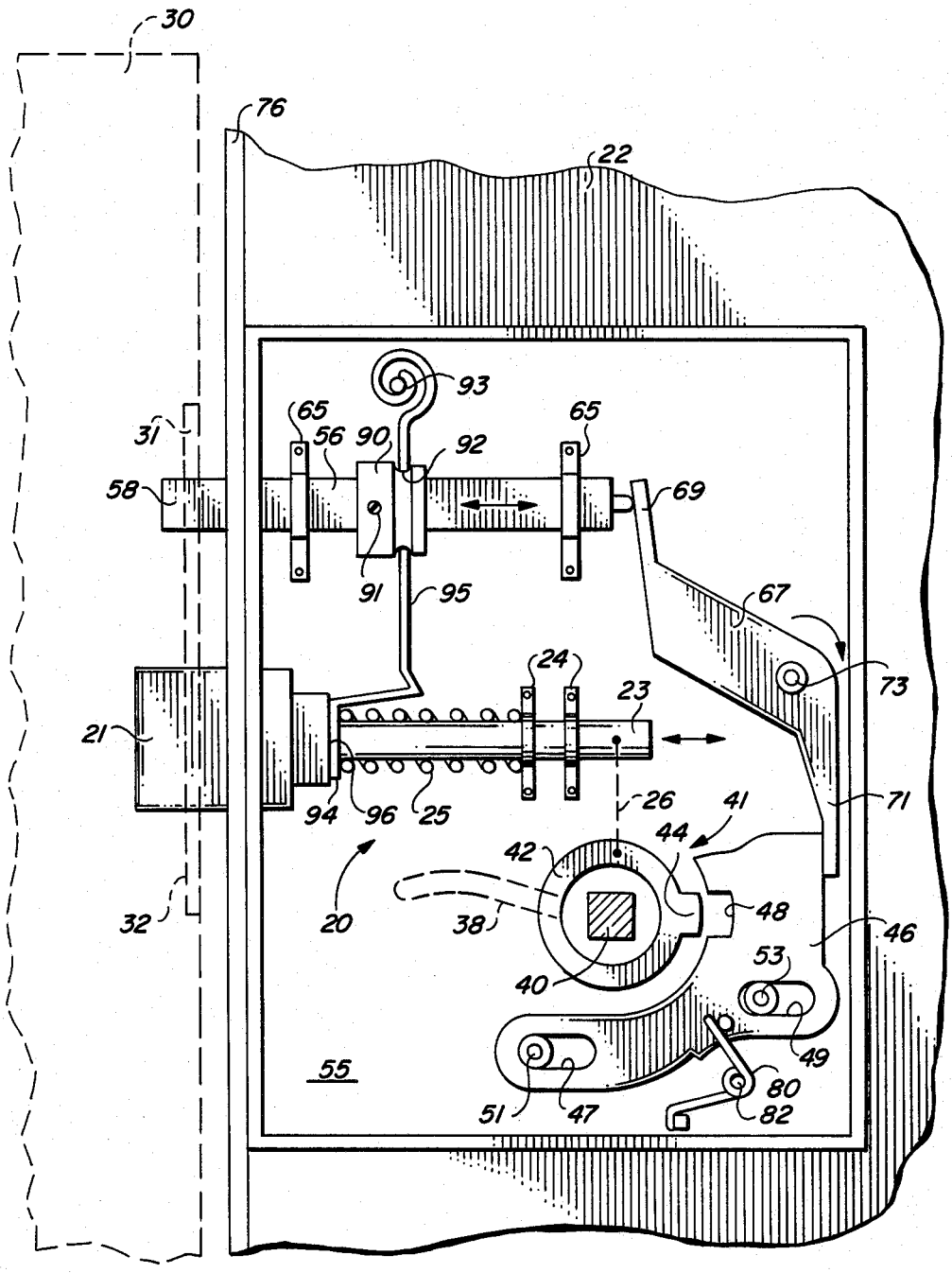
FIG. 1 is a schematic fragmentary side elevation illustrating a preferred embodiment of the closure assembly of the present invention, shown in the door open position with the door handle in the unlocked position.
Figure 2:
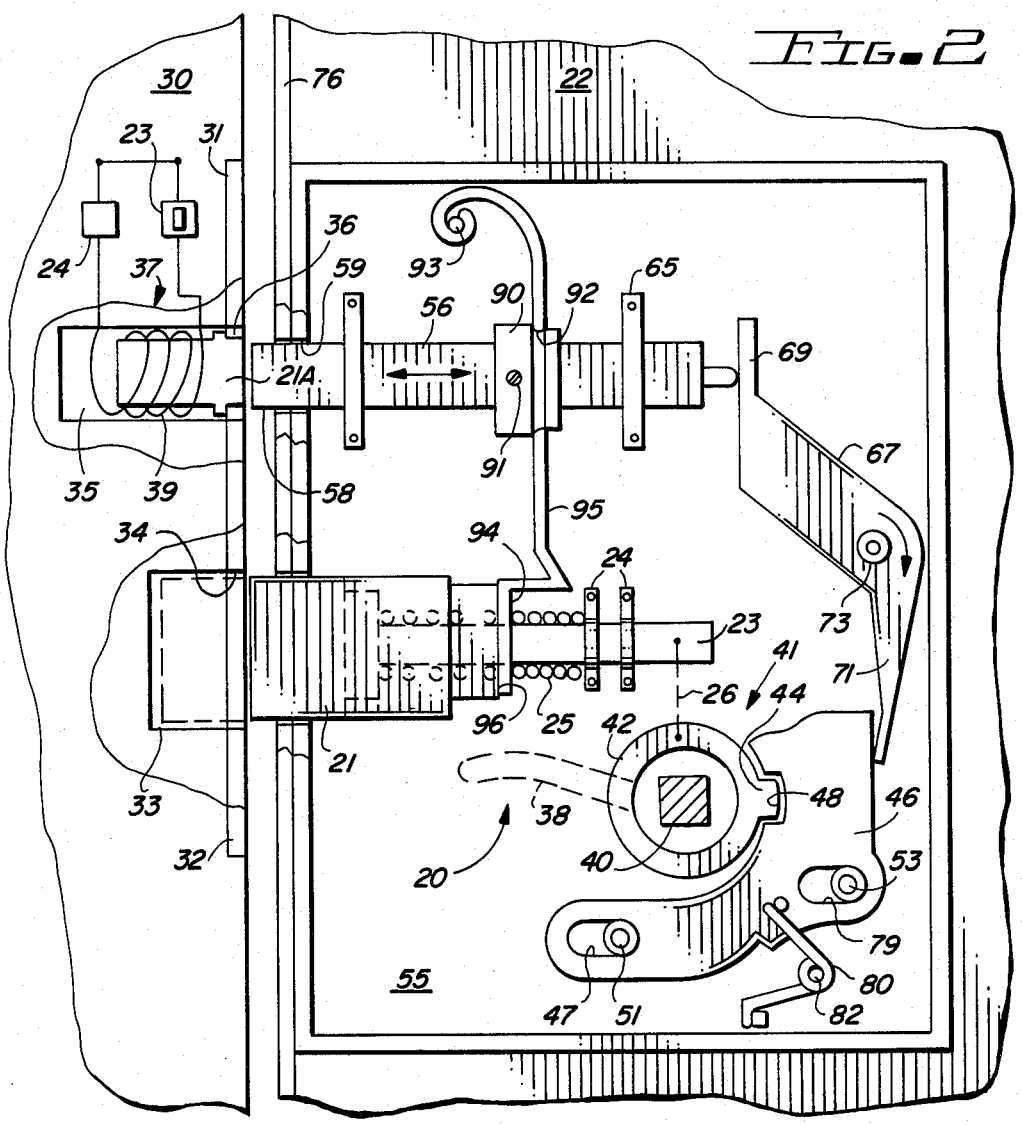
FIG. 2 is a schematic fragmentary side elevation of the door handle hub lock of FIG. 1 shown in the door closed position with door handle hub in a locked position.
Figure 3:
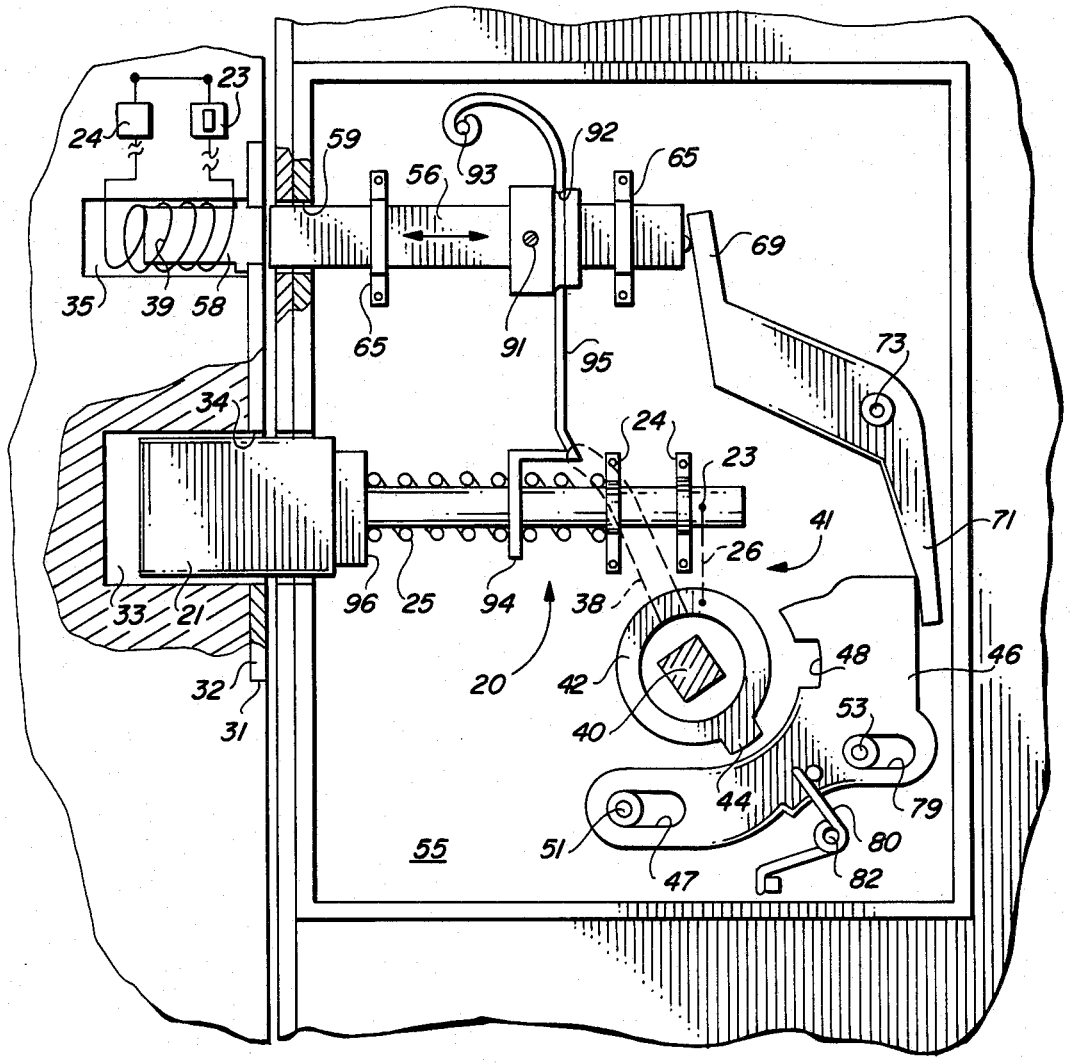
FIG. 3 is a schematic fragmentary side elevation of the door handle and hub lock shown in the door closed position with the door handle hub in an unlocked position.

Now referring more particularly to FIGS. 1–3 of the drawings, a first preferred embodiment of the improved doorway closure assembly of the present invention is schematically depicted therein in fragmentary side elevation. Thus, assembly 20 is shown which includes a door 22 appropriately secured to frame (not shown). In FIG. 1, door jamb 30 with strike plate 31 is shown in phantom so as to present the respective inter-relationship of the components of assembly 20 and door jamb 30 and strike plate 31.

Assembly 20 may include a conventional primary locking mechanism such as latch 21, extension 23, retainers 24 and biasing spring 25 to lock door 22 closed.

Assembly 20 also includes a novel hub lock 41 in door 22 comprising a preferably circular hub plate 42 secured around hub 40 and including thereon a protrusion 44 extending outwardly from the periphery thereof. Lock 41 includes an elongated slide bolt member 46, having a recess 48 which is dimensioned to receive protrusion 44. Bolt member 46 has two horizontally extending openings 47 and 49 which receive posts 51 and 53 which in turn are fixedly secured to lock base 55. The combination of posts 51 and 53 with openings 49 and 51 allow limited horizontal to and fro movement of bolt member 46.

Latch 21 is normally biased outwardly from base 55 by spring 25. Rotation of handle 38 about hub 40 causes retraction of latch 21 through any conventional interconnection means shown generally by dotted line 26.

Figure 4:
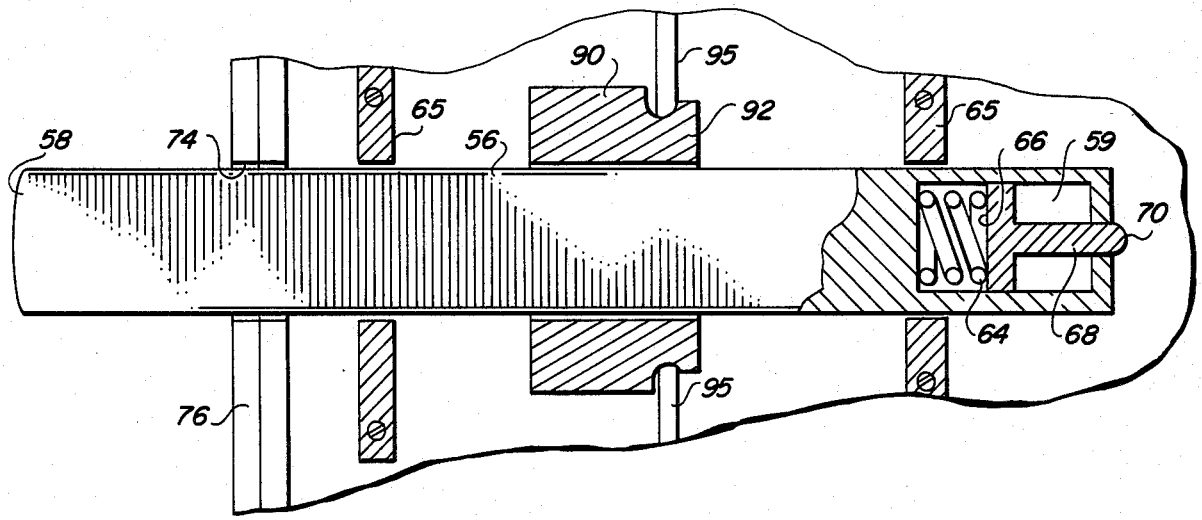
FIG. 4 is an enlarged schematic side elevation of the actuator plunger and spring lost-motion assembly and elongated actuator with a rounded end.

Lock 41 includes an actuator 56 having an elongated, essentially-flat head 58 at one end and a plunger receiving cavity 59 (FIG. 4) in the reverse end thereof. An impellar 68 having a T-shape is biased outwardly from cavity 59 by a coil spring 64 with the back 66 of impellar 68 bearing thereagainst. Supports 65 are provided to hold actuator 56 in place while allowing to and fro movement of actuator 56.

A direction-reversing member 67 is provided, having arms 69 and 71, and which is rotatable around pivot 73. The front tip 70 of impeller 68 bears against arm 69 of member 67. Head 58 is seated in opening 74 adapted to receive head 58. Opening 74 extends through face plate 76 of door 22.

Spring 80 is rotatably secured to pivot 82 to bias bolt member 46 to the right to thereby maintain protrusion 44 out of recess 48 and enable free rotation of hub 40.

Actuator 56 carries a moveable collar 96 which can be moved along actuator 56 for positioning at a preselected location and fixedly secured in such location by set screw 91. Collar 90 has a circumferentially extending channel 92 extending about its periphery. An elongated spring arm 95 has one secured to post 93 and extends downwards between the opening formed by channel 92 and base 55, under collar 90, and has its other end terminating in a loop 94 which surrounds both extension 23 and spring 25 and normally abuts latch 21 at its rear end 96. Arm 95 is slideably retained in channel 92. Retraction of latch 21 causes arm 95 to move collar 90 with actuator 56 to the right, in tandem action.

It can be seen that in an unlocked position, both the head 58 of actuator 56 and latch 21 project outwardly for a distance which significantly exceeds the distance between the face plate 76 and the rear side 32 of strike plate 31.

In FIG. 2, there is a showing of a first recess 33 located behind opening 34 in strike plate 31 which is adapted to receive latch 21 when latch 21 is positioned directly in front of opening 34. Another recess 35 is located directly behind opening 36 in face plate 31 which is adapted to receive actuator 56 when actuator 56 is located directly in front of opening 36. Actuator head 58 is urged into recess 35 by the action of springs 95 and 80, but prevented from movement thereinto by the rear end 96 of latch 21, as will be explained below.

Recess 35 contains a solenoid actuated device 37 including solenoid winding 39 and armature 21A, which is powered through an appropriate battery or other power source, with an appropriate reversing switch device 23. The application of power to the solenoid device 37 in a first direction through switch 23 causes armature 21A to move to the right, moving actuator 56 to the right and/or preventing head 58 to move into recess 35. The application of power to solenoid device 37 in a reverse direction through switch 23 causes armature 21A to move to the left, allowing movement of actuator 56 into recess 35.

Figure 5:
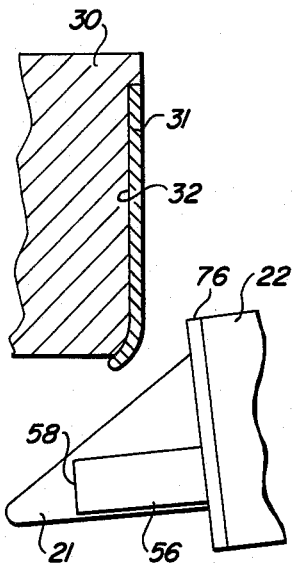
FIG. 5 is a partial schematic top view showing the inter-relationship of the strike plate, latch and actuator just before the door is about to be closed.
Figure 6:
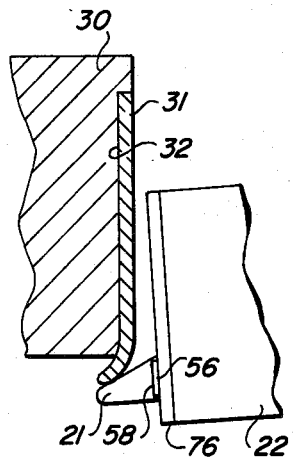
FIG. 6 is a partial schematic top view showing the inter-relationship of the strike plate, latch and actuator just prior to complete closure of the door.
Figure 7:
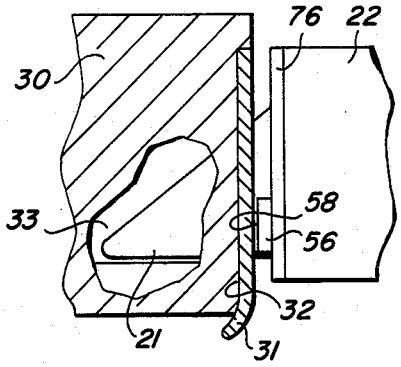
FIG. 7 is a partial schematic and broken away top view showing the inter-relationship of the strike plate latch and actuator after complete closure of the door.

FIGS. 5–7: Method of Operation

When door 22 is in the open position away from jamb 30, as shown in FIG. 1, head 58 protrudes way out of opening 59 and springs 80 and 95 are in the relaxed position with protrusion 44 out of recess 48 and with door handle unlocked (FIG. 1). Likewise, latch 21 protrudes out from face 76 due to biasing springs 95, 80 and 25, all acting in concert to a relaxed state. It should be noted that head 58 extends outward from face plate 76 to a position past the back end 32 of strike plate 31. This relationship is more clearly shown in FIG. 5 which is a top view of the door and door frame corresponding to FIG. 1.

As the door closes, (see FIG. 6) latch 21 is cammed to the right by sliding contact with strike plate 31, while simultaneously moving actuator 56 to the right to clear strike plate 31. If spring arm 95 were not in place, actuator 56 would butt against strike plate 31, thereby preventing door closure.

In FIG. 2, the solid lines show the assembly in a position just prior to full closure of the door. The latch 21 is almost fully retracted, as is actuator 56. Solenoid device 37 has been actuated to prevent entry of actuator head 58 into recess 35 and protrusion 44 is in alignment with opening 48, allowing entry therein and locking of hub 40.

Upon full closure of the door, latch 21 is biased into recess 33 by spring 25, as can be seen in the dotted line representation of FIG. 2, while activated armature 21 prevents head 58 from entering recess 35 in response to pressure by spring arm 95. These respective positions of the strike plate 31, latch 21 and head 58 are represented in FIG. 7.

It is apparent that a reversal of switch 23 will cause armature 21 to move to the left, allowing head 58 to move into recess 35, thereby releasing pressure on arm 71, enabling spring 80 to move member 46 to the right, uncovering protusion 44 to unlock hub 44. Rotation of hub 40 causes withdrawal of latch 21 from recess 33 (via connector 26) which will move loop 96 and arm 95 to the right, causing concurrent withdrawal of actuator 56 from recess 35, enabling opening of the door.

FIG. 3 shows the location of the various components when the door is closed and protrusion 44 and opening 48 were not in alignment. This non-alignment prevents locking of the hub 40 unless and until they are brought into alignment. The prevention of binding in the device is provided for by inclusion of the lost-motion assembly at the end of actuator 56, consisting of plunger 68 and spring 64 located in cavity 59. When the protrusion 44 and opening 48 are not aligned, movement of actuator 56 is cancelled out by depression of plunger 68 to the left, resulting in a net zero rotation of arm 69.

It should be emphasized that applicants' invention provides an elongated actuator whose length and extension outward from the face plate is not limited to the distance of the strike plate from the face plate, nor is the head of the actuator required to be rounded to provide a camming surface for interaction with the strike plate to cam the actuator out of the way and enable closure of the door. If poor workmanship in hanging the door results in a gap between the face plate and the strike plate which significantly exceeds design specifications, applicants' actuator will still work since it is of greater length, allowing for greater compensation and "play" in the door, frame and lock components. Further, some burglars sometime try to pry apart the door from the frame to unlock the door, thereby causing unlocking of the hub due to the limited length of the actuator and lack of play. With applicants' invention, opening of the door by prying would be made significantly more difficult.

It can be appreciated that the various types of lost-motion assemblies, biasing means and/or actuator/latch interconnection devices can readily be utilized in the invention set forth herein without departing from the scope and intent of the present invention.

What is claimed is:

1. An improved entry closure assembly, said assembly comprising, in combination:

(a) a door frame, (b) a donor secured to said frame for movement between an open and closed position, (c) a door locking and unlocking assembly disposed in said door and door frame, said assembly including (1) a door sub-assembly secured to said door and having (i) a latch member having camming means, (ii) a door handle hub, (iii) a door handle hub locking mechanism operatively connected to said hub, (iv) latch actuator means interconnecting said hub and latch member, (v) an actuator member, (vi) locking means interconnecting said actuator member and locking mechanism, and (vii) interconnection means for connecting said latch member and actuator member to cause simultaneous retraction of said latch member and actuator member, and (2) a frame sub-assembly secured to said door frame and having (i) a strike plate having first and second openings therein, (ii) said door frame having a recess therein disposed opposite said first opening which is adapted to receive said latch member, and (iii) said door frame also having an opening therein disposed opposite said second opening which is adapted to receive said actuator member, (3) whereby closure of said door causes said camming means to interact with said strike plate to move the latch member into the door sub-assembly thereby causing simultaneous movement of the actuator member into the door sub-assembly due to the presence of said interconnection means.

2. The assembly of claim 1, and further including actuator member positioning means for allowing or preventing movement of said actuator member into or out of said opening disposed opposite the second opening in said strike plate.

3. The assembly of claim 2 wherein said positioning means is a solenoid actuator assembly.

4. The assembly of claim 1 wherein said actuator member extends outwardly from said door a distance significantly greater than the distance between the door and the strike plate.

5. The assembly of claim 1 wherein said interconnection means includes means for adjusting the relative lengths of travel of said actuator member and latch member.

* * * * *